US007713106B2

(12) United States Patent
Sekiya

(10) Patent No.: US 7,713,106 B2
(45) Date of Patent: May 11, 2010

(54) DEVICE GRINDING METHOD

(75) Inventor: Kazuma Sekiya, Tokyo (JP)

(73) Assignee: Disco Corporation, Tokyo (JP)

( * ) Notice: Subject to any disclaimer, the term of this patent is extended or adjusted under 35 U.S.C. 154(b) by 17 days.

(21) Appl. No.: 12/078,733

(22) Filed: Apr. 3, 2008

(65) Prior Publication Data

US 2008/0254715 A1 Oct. 16, 2008

(30) Foreign Application Priority Data

Apr. 13, 2007 (JP) ..... 2007-105461

(51) Int. Cl.
*B24B 49/00* (2006.01)
*B24B 51/00* (2006.01)
*H01L 21/301* (2006.01)

(52) U.S. Cl. ..... 451/8; 438/464; 438/977; 451/6; 451/41; 451/63

(58) Field of Classification Search ..... 257/E21.598, 257/E21.599; 438/464, 460, 461, 462, 463; 451/6, 8, 10, 41, 63, 332
See application file for complete search history.

(56) References Cited

U.S. PATENT DOCUMENTS 6,301,009 B1 * 10/2001 Tinker ..... 356/511
6,852,608 B2 * 2/2005 Kitamura et al. ..... 438/464
2005/0260829 A1 * 11/2005 Uematsu et al. ..... 438/460

FOREIGN PATENT DOCUMENTS

JP 2001-351890 12/2001

* cited by examiner

*Primary Examiner*—Timothy V Eley
(74) *Attorney, Agent, or Firm*—Smith, Gambrell & Russell, LLP

(57) ABSTRACT

A device grinding method comprising the steps of holding the undersurface of a protective member which supports a plurality of devices by affixing their front surfaces onto the top surface of the protective member, on the chuck table of a grinding machine and grinding the rear surfaces of the plurality of devices held on the chuck table through the protective member by a grinding means while the chuck table is rotated, to form the thicknesses of the plurality of the devices to have a predetermined value, wherein the metering portion of a non-contact thickness metering equipment is brought to a position right above the rotating rotation locus of a predetermined device out of the plurality of devices supported on the chuck table through the protective member, the rear surfaces of the plurality of devices are ground by the grinding means while the thickness of the rotating predetermined device is measured with the non-contact thickness metering equipment, and the grinding by the grinding means is terminated when the thickness of the device measured with the non-contact thickness metering equipment reaches a predetermined value.

1 Claim, 3 Drawing Sheets

DEVICE GRINDING METHOD

FIELD OF THE INVENTION

The present invention relates to a method of grinding the rear surfaces of a plurality of devices formed on a wafer such as a semiconductor wafer until their thicknesses become a predetermined value after it is divided into the plurality of devices.

DESCRIPTION OF THE PRIOR ART

In the production process of a semiconductor device, a device such as IC or LSI is formed in a plurality of areas sectioned by streets (dividing lines) which are formed in a lattice pattern on the front surface of a substantially disk-like wafer, and individual devices are manufactured by dividing this semiconductor wafer into the areas each having a device formed thereon, along the streets. In general, the rear surface of the wafer is ground to a predetermined thickness by a grinding machine before it is divided into individual chips.

Meanwhile, a production method in which the devices are rated by a quality checking with a tester before the wafer in which the plurality of devices have been formed, is divided into individual devices and the obtained individual devices of the same rating are ground to a thickness required for each application purpose is carried out. It is difficult to measure the thickness of each device directly in order to grind the rear surface of each device until its thickness becomes a predetermined value after the wafer is divided into individual devices.

To solve the above problem, a ring-shaped measurement frame having a thickness larger than the finish thickness and substantially the same thickness as that of each device before grinding is affixed onto a protective tape and a plurality of devices are affixed to an area surrounded by the ring-shaped measurement frame in the protective tape to combine the measurement frame with the devices through the protective tape. JP-A 2001-351890 discloses a grinding method in which the above measurement frame and the devices combined together through the protective tape are held on the chuck table of a grinding machine and ground at the same time while the thickness of the ring-shaped measurement frame is measured.

The grinding method disclosed by the above patent document has a problem with productivity because the ring-shaped measurement frame must be prepared and is not economical because the ring-shaped measurement frame is an article of consumption.

SUMMARY OF THE INVENTION

It is an object of the present invention to provide a device grinding method capable of grinding individual devices to a predetermined thickness without using an article of consumption such as a measurement frame.

To attain the above object, according to the present invention, there is provided a device grinding method comprising the steps of holding the undersurface of a protective member which supports a plurality of devices by affixing their front surfaces onto the top surfaces of the protective member, on the chuck table of a grinding machine and grinding the rear surfaces of the plurality of devices held on the chuck table through the protective member by a grinding means while the chuck table is rotated, to form the thicknesses of the plurality of devices to have a predetermined value, wherein the metering portion of a non-contact thickness metering equipment is brought to a position right above the rotating rotation locus of a predetermined device out of the plurality of devices held on the chuck table through the protective member, the rear surfaces of the plurality of devices are ground by the grinding means while the thickness of the rotating predetermined device is measured with the non-contact thickness metering equipment, and the grinding by the grinding means is terminated when the thickness of the device measured with the non-contact thickness metering equipment reaches a predetermined value.

Since the non-contact thickness metering equipment is used in the device grinding method of the present invention, the rear surfaces of the plurality of devices can be ground by the grinding means while the thicknesses of the individually divided devices are directly measured. Therefore, the ring-shaped measurement frame for measuring the thickness of each device indirectly does not need to be manufactured, thereby improving productivity and the thickness accuracy of each device.

DETAILED DESCRIPTION OF THE PREFERRED EMBODIMENT

A preferred embodiment of the present invention will be described in more detail with reference to the accompanying drawings.

Figure 1:
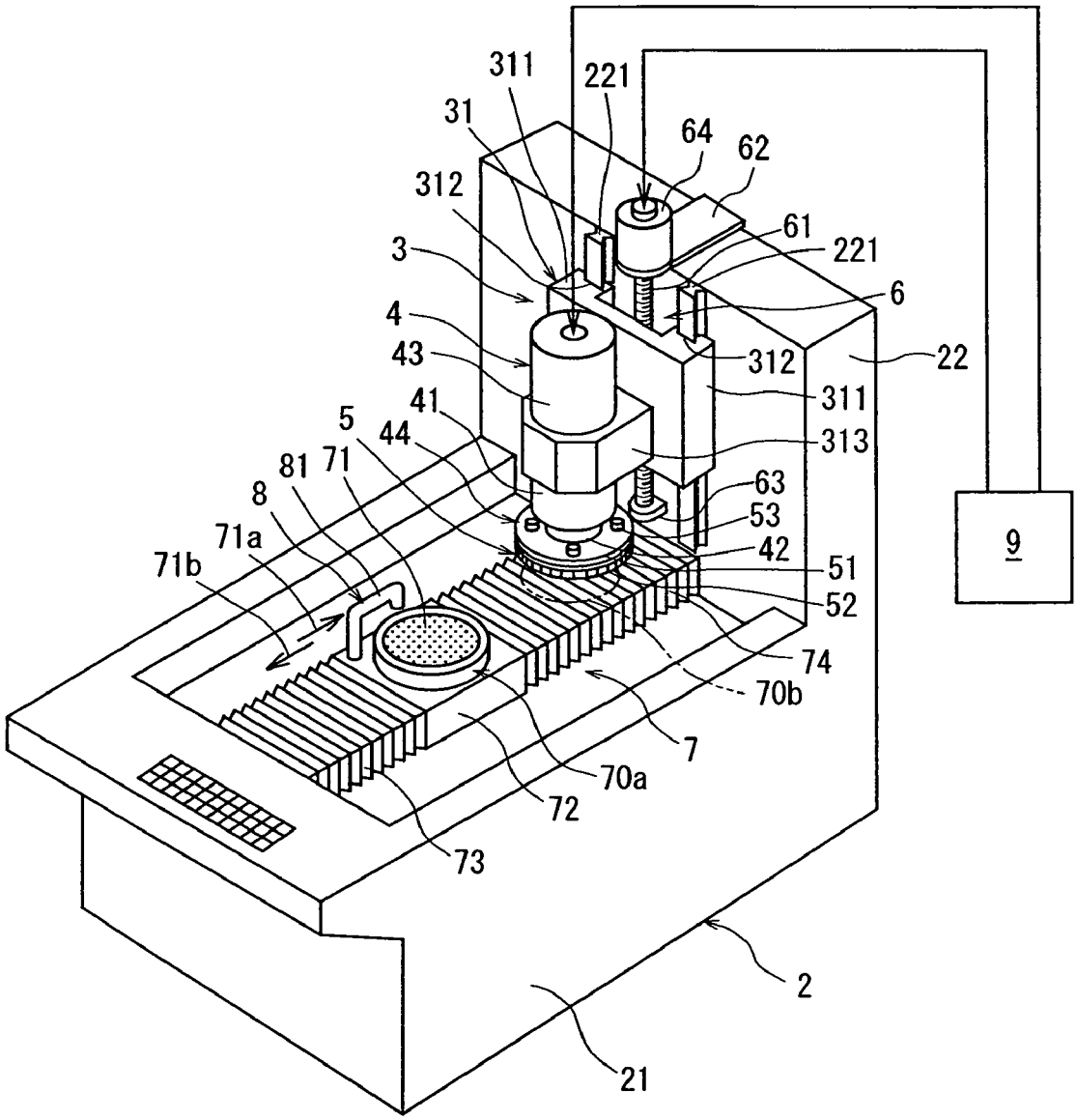
FIG. 1 is a perspective view of a grinding machine for carrying out the device grinding method of the present invention.

FIG. 1 is a perspective view of a grinding machine 1 for carrying out the device grinding method of the present invention. The grinding machine 1 shown in FIG. 1 comprises a housing generally denoted by 2. This machine housing 2 has a rectangular parallelepiped main body 21 and an upright wall 22 which projects upward substantially vertically and is mounted on the rear end portion (upper right end portion in FIG. 1) of the main body 21. A pair of guide rails 221 and 221 extending in the vertical direction is installed on the front side of the upright wall 22. A grinding unit 3 as a grinding means is mounted on the pair of guide rails 221 and 221 in such a manner that it can move in the vertical direction.

The grinding unit 3 comprises a movable base 31 and a spindle unit 4 attached to the movable base 31. The movable base 31 has a pair of leg portions 311 and 311 extending in the vertical direction on both side portions of the rear surface, and to-be-guided grooves 312 and 312 to be slidably fitted to the pair of guide rails 221 and 211 are formed in the pair of leg portions 311 and 311, respectively. A support portion 313 projecting forward is provided on the front side of the movable base 31 which is slidably mounted on the pair of guide rails 221 and 221 on the upright wall 22. The spindle unit 4 as a grinding means is installed in the support portion 313.

The spindle unit 4 as a grinding means comprises a spindle housing 41 mounted on the support portion 313, a rotary spindle 42 rotatably mounted in the spindle housing 41, and a servo motor 43 as a drive source for rotary-driving the rotary spindle 42. The rotary spindle 42 rotatably supported in the spindle housing 41 has one end portion (lower end portion in FIG. 1) which projects from the lower end of the spindle housing 41, and a wheel mount 44 is attached to the one end (lower end in FIG. 1) of that portion. A grinding wheel 5 is mounted on the undersurface of this wheel mount 44. This grinding wheel 5 is constituted by an annular grindstone base 51 and a plurality of segments, each composed of a grindstone 52 mounted on the undersurface of the grindstone base 51, and the grindstone base 51 is mounted on the wheel mount 44 by fastening screws 53. The above servo motor 43 is controlled by a control means 9 which will be described later.

The illustrated grinding machine 1 has a grinding unit feed mechanism 6 for moving the above grinding unit 3 in the vertical direction (direction perpendicular to the holding surface of a chuck table which will be described later) along the pair of guide rails 221 and 221. This grinding unit feed mechanism 6 has a male screw rod 61 which is mounted on the front side of the upright wall 22 and extends substantially vertically. The upper end portion and lower end portion of this male screw rod 61 are rotatably supported by bearing members 62 and 63 mounted on the upright wall 22, respectively. A pulse motor 64 as a drive source for rotary-driving the male screw rod 61 is installed on the upper bearing member 62 and the output shaft of the pulse motor 64 is transmission-coupled to the male screw rod 61. On the rear side of the movable base 31, there is provided a coupling section (not shown) projecting backward from the center portion in its width direction. A threaded through-hole (not shown) extending in the vertical direction is formed in this coupling section, and the male screw rod 61 is screwed into this threaded through-hole. Therefore, when the pulse motor 64 is rotated in the normal direction, the movable base 31, that is, the grinding unit 3 is moved down, namely, advanced, and when the pulse motor 64 is rotated in the adverse direction, the movable base 31, that is, the grinding unit 3 is moved up, namely, backed up. The pulse motor 64 is controlled by the control means 9 that is described later.

A chuck table mechanism 7 is installed in the main body 21 of the above machine housing 2. The chuck table mechanism 7 comprises a chuck table 71, a cover member 72 for covering a portion around the chuck table 71, and bellows means 73 and 74 installed in the front and the rear of the cover member 72. The chuck table 71 is designed to be rotated by a rotary-drive means (not shown) and to suction-hold a wafer as a workpiece on the front surface of the chuck table 71 by activating a suction means that is not shown. The chuck table 71 is moved between a workpiece mounting area 70*a* shown in FIG. 1 and a grinding area 70*b* opposed to the grinding wheel 5 constituting the above spindle unit 4 by a chuck table moving means that is not shown. The bellows means 73 and 74 may be made from a suitable material such as canvas cloth. The front end of the bellows means 73 is fixed to the front end wall of the main body 21 and the rear end of the bellows means 73 is fixed to the front end wall of the cover member 72. The front end of the bellows means 74 is fixed to the rear end wall of the cover member 72 and the rear end of the bellows means 74 is fixed to the front side of the upright wall 22 of the machine housing 2. When the chuck table 71 is moved in the direction indicated by the arrow 71*a*, the bellows means 73 is expanded and the bellows means 74 is contracted, and when the chuck table 71 is moved in the direction indicated by the arrow 71*b*, the bellows means 73 is contracted and the bellows means 74 is expanded.

The illustrated grinding machine 1 comprises a non-contact thickness metering equipment 8 for measuring the thickness of each device which is held on the chuck table 71 mounted on the above cover member 72. As this non-contact thickness metering equipment 8 may be used a thickness metering equipment disclosed by JP-A 2006-38744 applied for a patent by the present applicant.

The non-contact thickness metering equipment 8 will be described with reference to FIG. 2.

Figure 2:
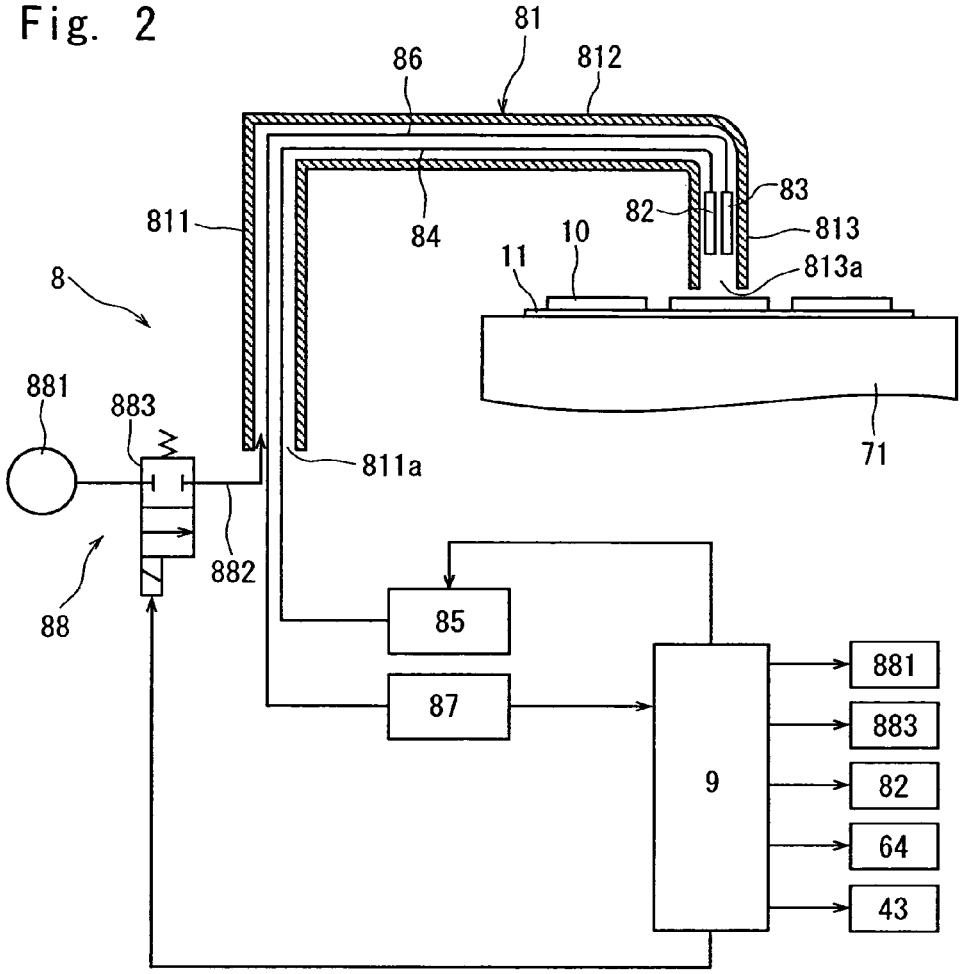
FIG. 2 is a constitutional block diagram of a non-contact thickness metering equipment provided in the grinding machine shown in FIG. 1.

The non-contact thickness metering equipment 8 shown in FIG. 2 comprises a cylindrical metering case 81 installed in the above cover member 72. This cylindrical metering case 81 has a support portion 811 which is installed upright and has an opening 811*a* at the lower end, a horizontal portion 812 which extends horizontally from the upper end of the support portion 811, and a metering portion 813 which extends downward from the end of the horizontal portion 812 and has an opening 813*a* at the lower end. The support portion 811 is supported to the above cover member 72 in such a manner that it can turn. The support portion 811 is designed to be turned by a turn-drive means that is not shown. Therefore, the metering portion 813 of the cylindrical metering case 81 is swung with the support portion 811 as a center thereof by causing to turn the support portion 811 by means of the turn-drive means that is not shown.

An ultrasonic wave transmitter 82 and a reflected wave receiver 83 are installed in the metering portion 813 of the above cylindrical metering case 81. The ultrasonic wave transmitter 82 is connected to an ultrasonic oscillation means 85 through an ultrasonic propagation means 84. The reflected wave receiver 83 is connected to a reflected wave receiving means 87 through an ultrasonic propagation means 86. This reflected wave receiving means 87 supplies a received signal to the control means 9. The non-contact thickness metering equipment 8 in the illustrated embodiment comprises a fluid supply means 88 for supplying a fluid to the metering portion 813 of the cylindrical metering case 81. This fluid supply means 88 comprises, for example, a pure water supply means 881 for supplying pure water and an electromagnetic on-off valve 883 installed in a pipe 882 for connecting the pure water supply means 881 to the opening 811*a* of the above support portion 811. The above control means 9 controls the ultrasonic wave transmitter 82, the electromagnetic on-off valve 883 and also the servo motor 43 of the spindle unit 4 as the grinding means and the pulse motor 64, based on a received signal from the reflected wave receiving means 87.

The illustrated grinding machine 1 is constituted as described above, and the method of grinding the plurality of devices by means of the above grinding machine 1 will be described hereinbelow.

Figure 3:
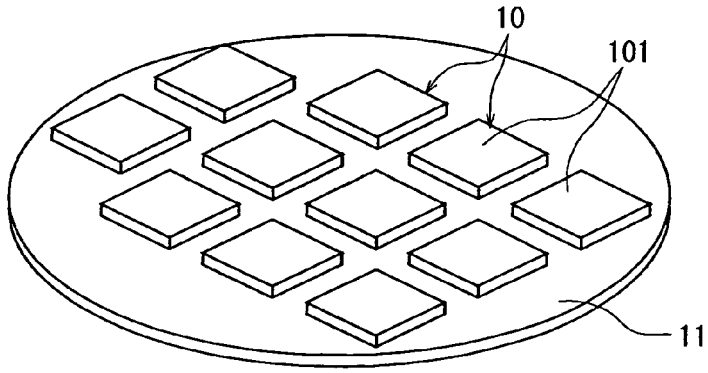
FIG. 3 is a perspective view showing a state of a plurality of devices being affixed onto the front surface of a protective member.

FIG. 3 is a perspective view of the plurality of devices 10 affixed to the surface of a protective member 11. The device 10 is manufactured by cutting the plurality of the devices formed on the front surface of a silicon wafer having a thickness of, for example, 700 μm and rated the same based on the results of a quality checking by a tester. The front surfaces having circuits formed thereon, of the plurality of devices 10 are affixed to the top surface of the protective member 11 (device supporting step). Therefore, the rear surfaces 101 of the plurality of devices 10 face up.

The undersurface of the protective member 11 having the plurality of devices 10 affixed onto its top surface is placed on the chuck table 71 positioned at the workpiece mounting area 70*a* of the grinding machine 1 as shown in FIG. 1. Therefore, the rear surfaces 101 of the plurality of devices 10 affixed to the top surface of the protective member 11 face up. The plurality of devices 10 placed on the chuck table 71 are suction-held on the chuck table 71 by the suction means (not shown) through the protective member 11 (device holding step). After the plurality of devices 10 are suction-held on the chuck table 71, the control means 9 activates the chuck table moving means (not shown) to move the chuck table 71 in the direction indicated by the arrow 71*a* to bring the chuck table 71 to the grinding area 70*b* , and specifically, beneath the peripheries of the plurality of grindstones 52 of the grinding wheel 5 such that the grindstones 52 pass over the center of rotation of the chuck table 71. Then, the control means 9 activates the turn-drive means (not shown) to turn the support portion 811 constituting the cylindrical metering case 81 of the non-contact thickness metering equipment 8 to bring the metering portion 813 to a position right above the predetermined rotation locus of a predetermined device 10*a* out of the plurality of devices 10 held on the chuck table 71 through the protective member 11 (metering position setting step).

Figure 4:
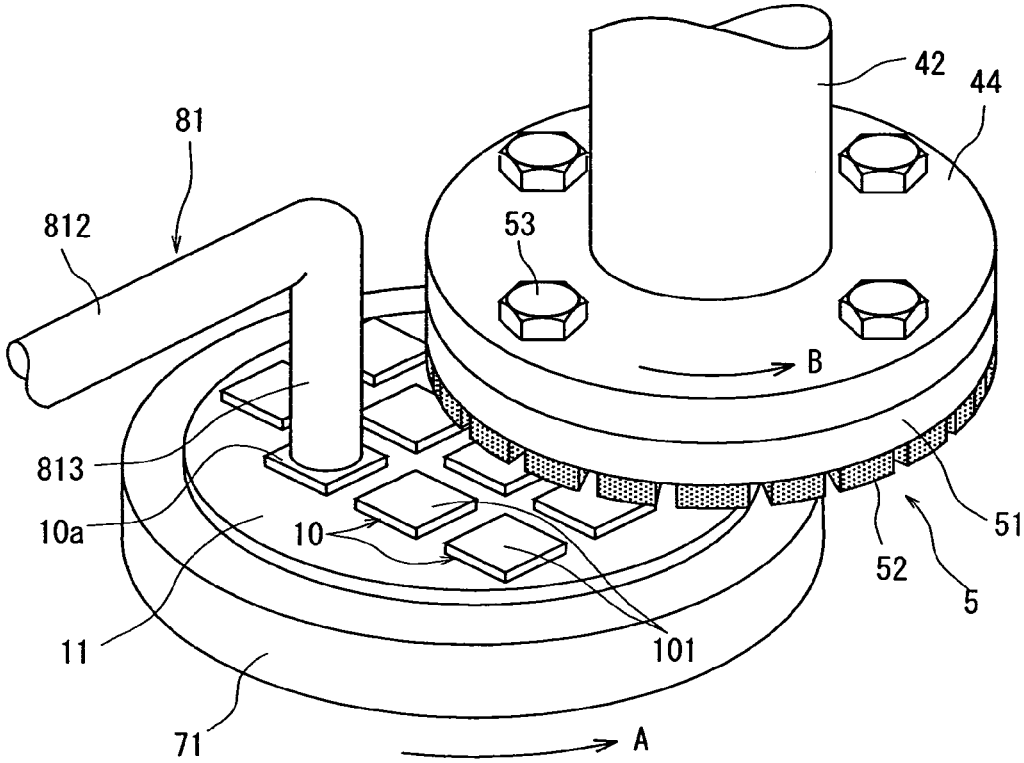
FIG. 4 is an explanatory diagram showing the relationship between the plurality of devices held on the chuck table of the grinding machine shown in FIG. 1 and a grinding wheel.

After the grinding wheel 5 and the plurality of devices 10 held on the chuck table 71 are set at the predetermined position relationship and the metering portion 813 constituting the cylindrical metering case 81 of the non-contact thickness metering equipment 8 is located at a metering position, the control means 9 drives the rotary-drive means (not shown) to rotate the chuck table 71 in the direction indicated by the arrow A in FIG. 4 at a revolution of, for example, 300 rpm and drives the above servo motor 43 to rotate the grinding wheel 5 in the direction indicated by the arrow B at a revolution of, for example, 6,000 rpm. Then, the control means 9 drives the pulse motor 64 of the grinding unit feed mechanism 6 in the normal direction to lower the grinding wheel 5 (for grinding) so as to press the plurality of grindstones 52 against the rear surfaces 101 (surface to be ground) which are the top surfaces of the plurality of devices 10, at a predetermined pressure. As a result, the rear surfaces 101 (surface to be ground) of the plurality of devices 10 are ground (grinding step).

In the above grinding step, the thickness of the predetermined device 10*a* which rotates along the predetermined rotation locus is measured by the non-contact thickness metering equipment 8. The step of metering the thickness of the device 10*a* will be described below.

Since the chuck table 71 holding the plurality of devices 10 is rotated at a revolution of 300 rpm as described above, it makes 5 revolutions in one second. Therefore, the predetermined device 10*a* which rotates along the predetermined rotation locus passes right below the metering portion 813 constituting the cylindrical metering case 81 of the non-contact thickness metering equipment 8 five times in one second. So, the control means 9 activates the ultrasonic oscillation means 85 and the reflected wave receiving means 87 constituting the non-contact thickness metering equipment 8 to oscillate a pulse ultrasonic wave from the ultrasonic oscillating means 85 once in one second. Therefore, the control means 9 reads a received signal received by the reflected wave receiving means 87 once each time the chuck table 71 makes 5 revolutions.

Figure 5:
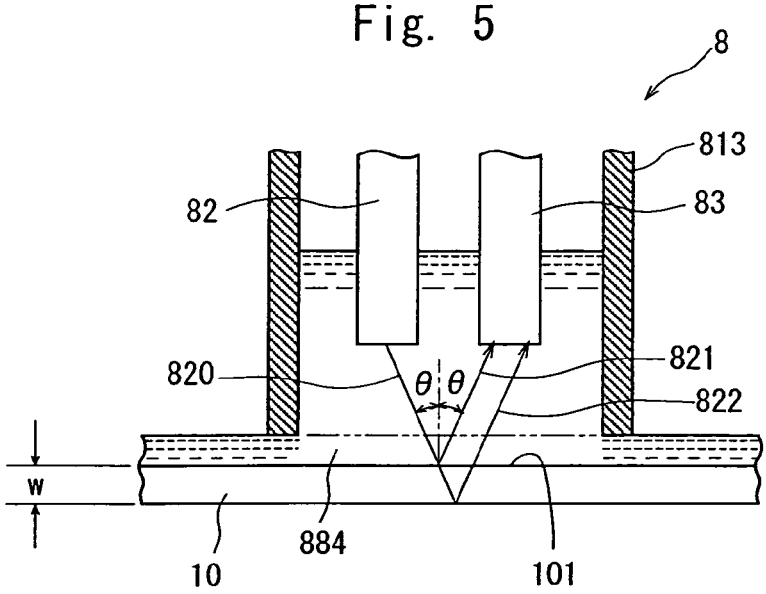
FIG. 5 is an enlarged sectional view of the metering portion of the non-contact thickness metering equipment provided in the grinding machine shown in FIG. 1.

The procedure of measuring the thickness of the device 10*a* with the non-contact thickness metering equipment 8 is described below. To measure the thickness of the device 10*a* with the non-contact thickness metering equipment 8, the control means 9 turns on the electromagnetic on-off valve 883 to open it. As a result, pure water is supplied from the pure water supply means 881 into the cylindrical metering case 81 through the pipe 882. The pure water supplied into the cylindrical metering case 81 flows over the plurality of devices 10 held on the chuck table 71 from the opening 813*a* of the metering portion 813 as shown in FIG. 5, thereby forming a fluid film 884 between the top surface (rear surface 101) of the device 10 and the opening 813*a* and filling a portion below the metering portion 813 (that is, portion below the wave transmitting portion of the ultrasonic wave transmitter 82 and the wave receiving portion of the reflected wave receiver 83). Then, the control means 9 activates the ultrasonic oscillation means 85 and the reflected wave receiving means 87 constituting the non-contact thickness metering equipment 8. As a result, a pulse ultrasonic wave 820 having a frequency of, for example, about 30 MHz is oscillated from the ultrasonic wave transmitter 82. The ultrasonic wave 820 oscillated from the ultrasonic wave transmitter 82 is reflected on the top surface (rear surface 101) of the device 10 and the undersurface (front surface) of the device 10. A first reflected wave 821 reflected on the top surface (rear surface 101) of the device 10 and a second reflected wave reflected on the undersurface (front surface) of the device 10 are received by the reflected wave receiver 83 and propagated to the reflected wave receiving means 87 through the ultrasonic propagation means 86. Thus, the reflected wave receiving means 87 which has received the first reflected wave 821 and the second reflected wave 822 supplies a received signal to the control means 9. Since a fluid (pure water) is filled between the wave transmitting portion of the ultrasonic wave transmitter 82 and the wave receiving portion of the reflected wave receiver 83 and the device 10, an ultrasonic wave propagates well.

The control means 9 calculates the thickness of the device 10 based on the received signal from the reflected wave receiving means 87. That is, the thickness of the device. 10 can be obtained by calculating the difference between the time period from the time when a pulse ultrasonic wave is oscillated from the ultrasonic oscillation means 85 to the time when the first reflected wave 821 from the top surface (rear surface 101) of the device 10 is received by the reflected wave receiving means 87 and the time period from the time when a pulse ultrasonic wave is oscillated from the ultrasonic oscillation means 85 to the time when the second reflected wave 822 from the undersurface (front surface) of the device 10 is received by the reflected wave receiving means 87. Stated more specifically, when the time period from the time when a pulse ultrasonic wave is oscillated from the ultrasonic oscillation means 85 to the time when the first reflected wave 821 from the top surface (rear surface 101) of the device 10 is received by the reflected wave receiving means 87 is represented by T1, the time period from the time when a pulse ultrasonic wave is oscillated from the ultrasonic oscillation means 85 to the time when the second reflected wave 822 from the undersurface (front surface) of the device 10 is received by the reflected wave receiving means 87 is represented by T2, the sound speed in the inside of the device 10 is represented by V, and the incident angle and reflection angle of the ultrasonic wave 820 are represented by θ, the thickness W of the device 10 can be obtained from the following equation:

$$W=V\times(T2-T1)\times\cos\theta\div 2$$

The above grinding step is carried out while the thickness W of the device 10 is measured with the non-contact thickness metering equipment 8 as described above. When the thickness W of the device 10 measured with the non-contact thickness metering equipment 8 becomes a set value (for example, 300 μm), the control means 9 drives the pulse motor 64 of the grinding unit feed mechanism 6 in the opposite direction to lift the grinding wheel 5. As a result, the grinding function of the grinding wheel 5 ends.

Since the non-contact thickness metering equipment 8 is used in the device grinding method of the present invention as described above, the rear surfaces of the plurality of devices 10 can be ground by the grinding means while the thicknesses of the individual devices 10 are directly measured, thereby eliminating the need for manufacturing a ring-shaped measurement frame for measuring the thickness of each device 10 indirectly. Therefore, productivity and the thickness accuracy of each device are improved.

While the invention has been described based on the embodiment shown in the accompanying drawings, it is to be understood that the invention is not limited thereto and that various changes and modifications may be made in the invention without departing from the spirit and scope thereof. For example, although a thickness metering equipment using an ultrasonic wave is used as the non-contact thickness metering equipment in the illustrated embodiment, a non-contact thickness metering equipment using a laser beam may be used.

What is claimed is:

1. A device grinding method comprising the steps of:

holding an undersurface of a protective member which supports a plurality of devices by affixing front surfaces of the plurality of devices onto a top surface of the protective member on a chuck table of a grinding machine; and grinding rear surfaces of the plurality of devices held on the chuck table through the protective member by a grinding means while the chuck table is rotated to form thicknesses of the plurality of the devices having a predetermined value, wherein a metering portion of a non-contact thickness metering equipment is brought to a position right above a rotating rotation locus of a predetermined device out of the plurality of devices held on the chuck table through the protective member, the rear surfaces of the plurality of devices are ground by the grinding means while the thickness of the rotating predetermined device is measured with the non-contact thickness metering equipment, and grinding by the grinding means is terminated when the thickness of the device measured with the non-contact thickness metering equipment reaches the predetermined value.

* * * * *